US008532832B2

(12) United States Patent
Cowans et al.

(10) Patent No.: US 8,532,832 B2
(45) Date of Patent: Sep. 10, 2013

(54) METHOD AND APPARATUS FOR THERMAL EXCHANGE WITH TWO-PHASE MEDIA

(75) Inventors: Kenneth W. Cowans, Fullerton, CA (US); William W. Cowans, Fullerton, CA (US); Glenn Zubillaga, Canyon Lake, CA (US)

(73) Assignee: BE Aerospace, Inc., Wellington, FL (US)

( * ) Notice: Subject to any disclaimer, the term of this patent is extended or adjusted under 35 U.S.C. 154(b) by 885 days.

(21) Appl. No.: 12/558,641

(22) Filed: Sep. 14, 2009

(65) Prior Publication Data

US 2010/0076611 A1 Mar. 25, 2010

Related U.S. Application Data

(60) Provisional application No. 61/192,881, filed on Sep. 23, 2008, provisional application No. 61/179,745, filed on May 20, 2009.

(51) Int. Cl.

| | |
|---|---|
| ***G05D 11/16*** | (2006.01) |
| ***F25B 41/04*** | (2006.01) |
| ***F25B 41/00*** | (2006.01) |

(52) U.S. Cl.

USPC ..... 700/285; 700/299; 62/222; 62/483; 62/513; 62/537; 62/196.4; 62/196.1; 62/196.3; 62/190; 62/199

(58) Field of Classification Search

USPC ..... 700/285, 299; 62/222, 483, 513, 62/537

See application file for complete search history.

(56) References Cited

U.S. PATENT DOCUMENTS

| | | | | |
|---|---|---|---|---|
| 6,077,158 | A * | 6/2000 | Lake et al. | 454/70 |
| 6,460,358 | B1 * | 10/2002 | Hebert | 62/225 |
| 6,775,996 | B2 * | 8/2004 | Cowans | 62/160 |
| 7,178,353 | B2 * | 2/2007 | Cowans et al. | 62/196.4 |
| 7,337,625 | B1 * | 3/2008 | Cowans | 62/210 |
| 7,415,835 | B2 * | 8/2008 | Cowans et al. | 62/190 |
| 8,240,160 | B2 * | 8/2012 | Cowans et al. | 62/196.4 |
| 2003/0145610 | A1 * | 8/2003 | Leuthner | 62/141 |
| 2005/0183432 | A1 * | 8/2005 | Cowans et al. | 62/190 |
| 2007/0095097 | A1 * | 5/2007 | Cowans et al. | 62/512 |
| 2009/0105889 | A1 * | 4/2009 | Cowans et al. | 700/299 |
| 2009/0205345 | A1 * | 8/2009 | Narayanamurthy et al. | 62/113 |
| 2010/0138049 | A1 * | 6/2010 | Creed et al. | 700/276 |

FOREIGN PATENT DOCUMENTS

JP 3-117866 * 5/1991

* cited by examiner

*Primary Examiner* — Kavita Padmanabhan
*Assistant Examiner* — Olvin Lopez Alvarez
(74) *Attorney, Agent, or Firm* — Fulwider Patton LLP

(57) ABSTRACT

In a temperature control system using a controlled mix of high temperature pressurized gas and a cooled vapor/liquid flow of the same medium to cool a thermal load to a target temperature in a high energy environment, particular advantages are obtained in precision and efficiency by passing at least a substantial percentage of the cooled vapor/liquid flow through the thermal load directly, and thereafter mixing the output with a portion of the pressurized gas flow. This "post load mixing" approach increases the thermal transfer coefficient, improves control and facilities target temperature change. Ad added mixing between the cooled expanded flow and a lesser flow of pressurized gas also is used prior to the input to the thermal load. A further feature, termed a remote "Line Box", enables transport of the separate flows of the two phase medium through a substantial spacing from pressurizing and condensing units without undesired liquefaction in the transport lines.

19 Claims, 6 Drawing Sheets

| Parameters | | Conventional Chiller | Direct Chiller | Improvement Rate |
|---|---|---|---|---|
| Throughput | Ramp Up (sec) | 16 min, 9 sec | 4 min, 6 sec | 75% |
| | Ramp Down (sec) | 26 min, 4 sec | 5 min, 5 sec | 80% |
| | Response Time | 46 sec | 7 sec | 85% |
| Uniformity | Control Range | 3.7°C | 1.6°C | 57% |
| | On-Wafer Range | 20.39°C | 15.25°C | 25% |
| | | | | TOTAL AVG. 64.4% |

Fig. 6

METHOD AND APPARATUS FOR THERMAL EXCHANGE WITH TWO-PHASE MEDIA

REFERENCES TO PRIOR APPLICATIONS

This application relies for priority on similarly titled applications of the same inventors, namely a first provisional application filed Sep. 23, 2008, Ser. No. 61/192,881 and a second provisional application filed May 20, 2009, Ser. No. 61/179,745.

BACKGROUND OF THE INVENTION

With the growth of modern technology, improved temperature control systems have also been sought for maintaining a thermal load at a precise temperature under energy intensive conditions. Many such control systems also are required to change the temperature of the thermal load in accordance with process conditions, sometimes with great rapidity. As one illustration, semiconductor manufacturing equipment and processes are often dependent upon temperature control of the wafers or other elements on which various surfaces are being deposited or etched, using techniques which are highly energy intensive. It is thus often necessary to maintain a large semiconductor wafer which serves as the base for formation of thousands of minute complex integrated circuits, under precise temperature control, as the wafer is processed, as under plasma bombardment. By such processes, minute patterns may be selectively deposited or etched in the wafer surface.

Semiconductor manufacture is referenced here merely as one example of one process in which there is a need for precise temperature control under dynamic conditions. Other processes in which there are current or prospective demands for such capabilities will present themselves to those skilled in the art.

In the past, temperature stability in the item being processed has often been achieved by using particular fluids and geometries to define effective heat sinks, for withdrawing or supplying thermal energy from the operating zone as needed, to establish a desired effective temperature level in the item. It has been common, heretofore, to employ a thermal transfer medium which remains typically liquid throughout the entire temperature range used in a process. This medium can maintain adequate thermal transfer capability and at the same time avoid the complexity and unpredictability that would be introduced if a change of phase from liquid to vapor were to be introduced, wholly or partially.

Although the state of the art has been constantly evolving, few distinctly different methods were employed until a novel thermal control technique was introduced by Kenneth W. Cowans et al employing energy transfer using different phases of the same medium. Patents entitled "Thermal Control System and Method" (U.S. Pat. Nos. 7,178,353 and 7,425,835) have issued on this concept and are assigned to the assignee of the present application. This concept employs the thermodynamic properties of a refrigerant in both vapor and liquid phases, properly interrelated to exchange thermal energy with a load so as to maintain the temperature at a selected target level within a wide dynamic range. Consequently, the refrigerant can heat or cool a product and process, such as a semiconductor wafer of large size, at a single or a succession of different target temperatures. This concept has been referred to for convenience by the concise expression "Transfer Direct of Saturated Fluid", abbreviated TDSF. This descriptor recognizes and in a sense summarizes the operative sequence, in which a medium is first compressed to a high temperature gaseous state, then divided, under control, into two interdependent flows. One flow path maintains the fluid in high pressure gaseous phase, but in this flow path the flow rate and mass are varied in accordance with the target temperature to be maintained. Variation of the one flow affects the differential flow in the other path, in which the refrigerant is converted, by cooling, to liquid phase and the flow is then further cooled by expansion. In this path the flow rate is dependent on the heat load presented to the system. Typically, the flow in this liquefied path is regulated by a standard refrigeration thermo-expansion valve (TXV).

As disclosed in the referenced patents, the two flows, of high pressure gas and cooled expanded fluid/vapor, are recombined in a mixer before delivery to the thermal load. The target temperature for the load is established by adjusting the balance between the two flows by admitting a selected amount of hot gas flow, controlled such that needed pressure, temperature and enthalpy are maintained in a continuous loop.

The TDSF concept has numerous advantages. Some can be best expressed in terms of the range of temperatures that can be encompassed from hot (entirely pressurized gas) to maximum cooling (entirely expanded vapor). The concept also enables the load temperature to be maintained with precision. The target temperature can be adjusted bi-directionally and rapidly.

The use of a refrigerant having a temperature/pressure transition that is somewhere in mid-range relative to the operating temperature band, however, creates possibilities for undesired changes in refrigerant state under certain operating conditions. Situations have been encountered in which performance limitations have been imposed on TDSF systems because of installations which introduce substantial pressure drops or long transport lines for the refrigerant. These conditions can arise because, in a two-phase medium, pressure drops are also accompanied by temperature variations. For example, long line lengths from compressor and condenser units to a semiconductor processing site may be required for operative or geometrical considerations. Heretofore, installations which have inherently required the use of long transport distances for refrigerant media have sometimes imposed restraints on the use of the TDSF concept or the use of special expedients which add undesirable complexity and cost. It is also true that long lines can introduce another complication, that of 'puddling': If this occurs, the liquid phase can separate from the two-phase mixture creating variations in mass flow at the line's end. This can adversely alter control characteristics due to surging conditions as pure liquid and pure gaseous phases alternate with mixed two phase flow.

SUMMARY OF THE INVENTION

The present invention discloses a novel implementation of the TDSF concept of separating and later recombining a high pressure gas phase of a two-phase refrigerant medium with a cooled, liquefied and then expanded differential flow of the same medium, and application of the medium to the thermal load. In accordance with the invention the principal phase of the refrigerant that is propagated through the thermal load while the load is being heated is the cooled expanded differential flow. The combination of cooled expanded flow through the thermal load with the modulated high pressure gas flow occurs after as well as before the thermal load, so that this approach has been termed "Post Load Mixing" (PLM). The media fed into the thermal load heat exchanger is stabilized in temperature throughout its flow through that exchanger because it is responsive both to the enthalpy of the expanded component and the pressure modulated by the hot gas in the mixing process.

The PLM approach uses the two different phase states of the refrigerant in a uniquely integrated manner. The pressure of the suction line to the compressor is influenced by the mass of refrigerant received, since the compressor is a device that processes a fixed volume per unit of time. In the PLM system the flow through the thermal load has a smaller differential in temperature than would exist with unidirectional transport of fully mixed dual flows, and the thermal load temperature can be thus more tightly controlled. Essentially, the flow through the thermal load is so controlled as to be mainly or completely the cooled expanded component, and in consequence the pressure drop undergone by the refrigerant in passing through the load is lessened. Furthermore, by post load mixing after the refrigerant has passed through the load, the refrigerant passing through the thermal load has a greater percentage of liquid than if all the hot gas had been mixed before the load and thus has a higher heat transfer coefficient, so that thermal exchange is more efficient, particularly at and near the last portions of the heat exchanger passage.

The PLM concept employs some mixing of the two flows both before and after the thermal load, but in a selectable proportionality. This is done in a preferred embodiment by including two impedances in the paths supplying the high pressure hot gas to the mixing tees. Said impedances are settable as to magnitude. A flow of high pressure gas is branched off and combined with the cooled expanded flow at an input mixer coupled to the input to the thermal load. The flow bypassing the thermal load is also directed through a series-coupled solenoid valve which can be controlled so as to enable rapid changes of operating mode between post load mixing and fast heating of the thermal load. Said solenoid valve is closed when rapid heating of the thermal load is desired. This is usually employed when switching the load from one temperature to a hotter temperature, as when a chuck that is normally cold during processing is removed from the system to allow repair to be accomplished. Rapid heating will thus minimize the time needed for such repair and changeover.

The post load mixing approach may be used in certain geometries or applications requiring that the refrigerant be transported over a relatively large distance between the energizing (compressing and condensing) sites and the sites at which thermal exchange occurs. In accordance with the invention, substantial advantages are achieved in these situations by deploying the principal flow adjusting, combining and mixing circuits in a geometrically compact and thermodynamically adapted post load mixing unit, denoted the PLM line box (LB).

The PLM LB is for disposition in proximity to the thermal load and incorporates conduits for high pressure gas flow, liquefied refrigerant low, and return flow, as well as a thermo-expansion valve (TXV), an equalizer for the TXV, and check valves and mixing tees. The configuration, which forestalls mixing before the transport lines, is realized within a volume that is about one cubic foot or less. This unit may be described as comprising a remote control box.

In this combination, the thermo-expansion valve is proximately coupled to a temperature sensing bulb responsive to the temperature in the return line from the load after the mixing tee located downstream from the thermal load. Said thermo-expansion valve is also coupled with a pressure sensing line to the return line in a position proximate said temperature sensing bulb, which coupling serves to establish the external equalizer function. In those installations displaying a minimal pressure drop through the thermal load said thermo-expansion valve can be of the internally equalized type. When such non-equalizing valves are employed said coupling to the return line is not used. The two mixing tees are disposed separately, one before and one after the thermal load. The system may include a check valve before the first mixing tee, and, for flow regulation, a flow orifice is disposed before each mixing tee. A solenoid valve is located in series with the second mixing tee. Consequently, despite the fact that long transport lines may be needed between the phase conversion, energy demanding portions of the system and the thermal load at the process site, needed phase conversions and flow modulations are effected reliably without the danger of accumulation of internal liquids.

In accordance with other features of the invention, where transport lines and conditions present only marginal probability of liquefaction, the transport lines from the proportional valve and the thermo-expansion valve can be disposed to parallel but insulated externally from each other before being coupled to a mixer in the PLM configuration.

BRIEF DESCRIPTION OF THE DRAWINGS

A better understanding of the invention may be had by reference to the following description taken in conjunction with the accompanying drawings, in which:

FIG. 6 is a chart of tested performance characteristics of a system in accordance with the invention, in comparison to the performance of a conventional temperature control system, referred to as a "conventional chiller".

DETAILED DESCRIPTION OF THE INVENTION

Figure 1:
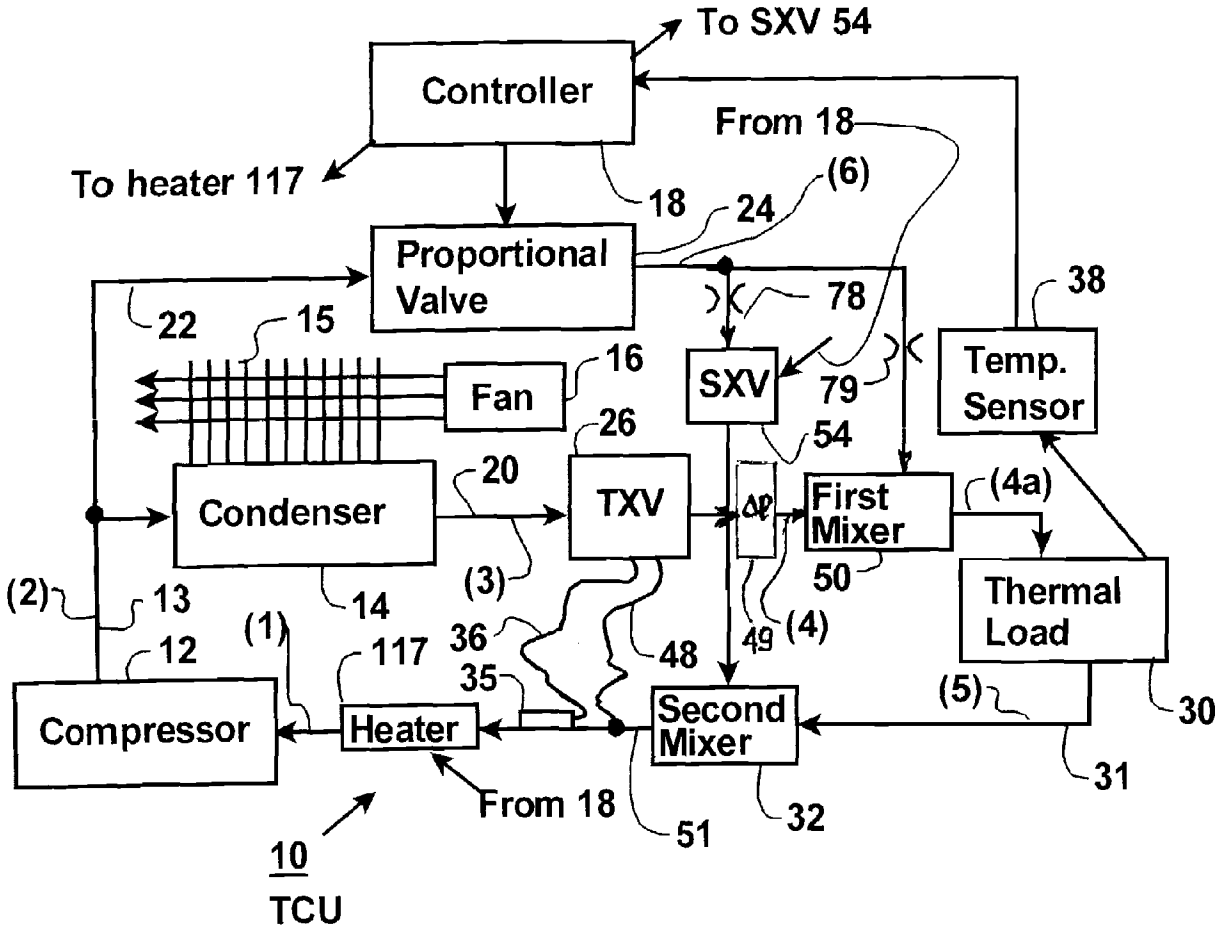
FIG. 1 is a block diagram of a system for thermal exchange using two-phase media in accordance with the PLM invention.

A generalized system utilizing post load mixing (PLM) is shown in FIG. 1, to which reference is now made. The thermal control system 10 or "TCU" is consistent with the TDSF concept but differentiated by incorporating the PLM approach, and forms a closed loop that encompasses an active thermal control system (TCU) 10 and a thermal load 30. The thermal load 30 is typically a heat exchanger that functions with a processing unit (not shown), such as a chuck for processing semiconductors. In the thermal control system 10 a refrigerant comprising a medium such as R-507 is input to a compressor 12 in gaseous form and a pressurized output is provided therefrom into a main line 13. One branch from the main line 13 includes an air cooled (in this example) condenser 14 having an external air-cooled fin structure 15 engaged by flow from a fan 16 shown only symbolically. The condenser 14 provides a fully or substantially liquefied output of refrigerant at an essentially ambient temperature in a first output path 20.

A separate branch from the compressor 12 output 13 is taken from a junction before the condenser 14 to direct pressurized hot gas from the compressor 12 into a second flow path 22. This second flow path 22 includes a proportional valve 24 that is operated by a controller 18 so as to adjust the proportion (in mass flow rate) or hot gas that is to be used out of the compressor 12 output. This adjustment modulates the two flows and ultimately determines the proportion of hot gas to be employed in the consequent mixture of the two flows, as described below. The adjustment consequently sets the target temperature for the thermal load 30.

In the first branch 20 the output from the condenser 14 is applied to a thermo-expansion valve TXV 26, this output being dependent on and determined by the differential temperature between the superheated gas as sensed a proximate by bulb 35 and the temperature of output fluid from the second mixer 32 a point in line 51 adjacent where the bulb 35 is located. The thermo-expansion valve 26 thus senses the pressure difference between liquid contained within bulb 35 and the pressure sensed by a line 48 connected to externally equalized TXV 26. The output flow from the TXV 26 is here coupled to the thermal load 30, which is depicted only generally. Said output flow from the TXV 26 travels through a delta P valve 49 which valve performs the same function as disclosed in U.S. Pat. No. 7,178,353. After passing through valve 49 the expanded cooled output from the TXV 26 mixes with some of the hot gas in the first mixing tee 50. The output 31 from the load 30 is, in accordance with the PLM approach, returned to the input of the compressor 12 via one input of a second mixing tee 32, which also receives, at a separate input, some of the output from the proportional valve 24. The output line from the second mixing tee 32 returns to the compressor 12, but the input pressure of this return flow is sensed on route to the compressor 12 input by the external equalization bulb 35 which is coupled into the TXV 26 via the line 36. This connection also provides the known external equalization feature disclosed in the patents referred to above and in other patents and applications on the TDSF system, so that it need not be described in further detail. In addition, the controller 18 for the proportional valve 24 receives a temperature input from a sensor 38 that is responsive to the temperature level at the thermal load 30. Alternatively, said temperature sensor 38 may be mounted so as to sense any other location that is desired to regulate.

The PLM dual flow, dual mixing system, has other features and advantages. A solenoid valve, labeled SXV 54 is in the path from the proportional valve 24 to the second mixer 32. The SXV 54 is controlled by the controller 18, so it can be shut off whenever the system is programmed to make a change in the target temperature from one level to a higher level. Shutting off this path at the SXV 54 assures that all hot gases flow to the input of the first mixer 50, and more rapidly increase the temperature of the flow into the thermal load 30. In the input to the SXV 54, a settable impedance, shown symbolically, constituting a controllable orifice 78 is included, in parallel to a comparable settable impedance or controllable orifice 79 in the direct path to the first mixer 50. By the use of these control orifices 78 and 79, the two separate flows of pressurized gas fed into the first mixer 50 and second mixer 32 can be proportioned and balanced as desired. The system also includes, as shown, a heater 117 in the input to the compressor 12, which heater 117 may be activated by the controller 18 to convert a liquid containing mixture returning from the second mixer 32 to the wholly gaseous phase for proper operation of the compressor 12.

Mixing the hot gas from the proportional valve 24 with the cooled expanded flow from the TXV 26 after the thermal load 30 retains the essential benefits of the TDSF system, but offers particular added benefits. These are particularly applicable where substantial pressure drops or differentials in heat transfer coefficients may be encountered or exist within thermal load 30. The mass flow from the proportional valve 24, when combined with the system flow at the second mixing tee 32 and also with the TXV 26 output to the first mixing tee 50, modulates the pressure within the load 30. This variation affects the temperature within the circuit and thereby controls the temperature of the load. With PLM, the temperature level across a thermal load, such as a semiconductor chuck can be contained within tolerances that are more precise than previously expected. Tests of a practical system show a reduction in temperature differential to 3° C. from a prior 10° C. differential.

The media fed into the thermal load 30 is stabilized in temperature throughout its flow path in the heat exchanger therein because of the total pressure of the refrigerant fluid, which pressure is controlled by the proportion of hot gas propagated into the circuit. The pressure of the refrigerant in the suction line to the compressor 12 is influenced by the mass passed into the compressor, which compressor 12 processes a fixed volume per unit of time. Because of these interrelated factors, the thermal load 30 is more tightly temperature controlled than in non-PLM based systems. In the system shown, the flow through the thermal load 30 is generally restricted so as to be completely or almost completely that refrigerant that flows through the thermo-expansion valve 26. By so limiting the flow, the pressure drop undergone by the refrigerant passing through the load is lessened. Also, since the hot gas is mixed at the second mixer 32 with the two-phase output of the TXV 26 after the output has passed through the load 30 there is a greater percentage of liquid in the mix at this point. Thus the heat transfer coefficient is maintained high throughout the thermal load 30. Therefore, adjustments in the two flows can also be made after sensing the thermal load temperature, in order to anticipate temperature differentials.

Figure 5:
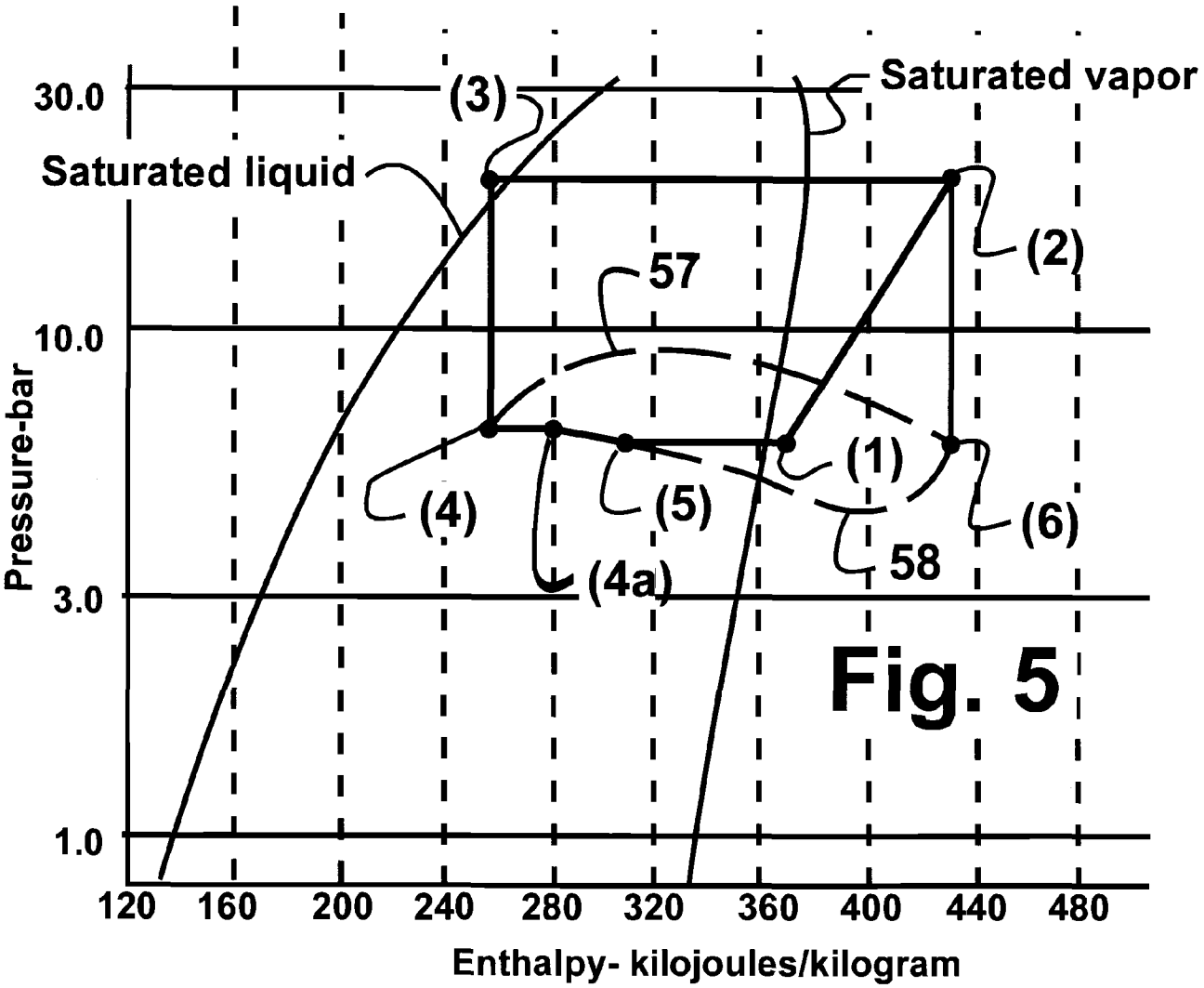
FIG. 5 is a Mollier diagram evidencing thermodynamic changes in states existing in a typical system in accordance with the invention, such as shown in FIG. 1.

Reference should now be made to the Mollier diagram of FIG. 5 which depicts the thermodynamic variations in enthalpy (abscissa) vs. pressure (ordinate) in a complete cycle for the system of FIG. 1. The pressure-enthalpy points in FIG. 5 are identified by numbers in parentheses to correspond to the similarly identified numbers in brackets positioned around the block diagram of FIG. 1. Thus the input at point (1) to the compressor 12 is, as seen in FIG. 5 increased by the compressor in pressure and enthalpy to point (2) before some of it is liquefied in condenser 14 to point (3). After controlled expansion to point (4) in the TXV 26, then consequently mixing some hot gas from the proportional valve 24 at point (6) in the first mixer 50 (see also FIG. 1) results in an increase in enthalpy to point (4*a*). This interchange is illustrated in FIG. 5 by the dotted line 57 between points (6) and (4). Passage of the refrigerant through the thermal load 30 absorbs heat from thermal load 30 and shifts the enthalpy to the point (5). The injection of pressurized hot gas at the input to the second mixing tee 32 of FIG. 1, as also shown at point (6), and depicted by dotted line 58 on FIG. 5. This input adjusts the heat and enthalpy from point (5) to point (1). The addition of hot gas at the mixing tees 50 and 32 also adjusts the pressure of the throughput flow, thus further and more precisely adjusting the temperature of the refrigerant at the thermal load 30. Consequently, the controller 18 may set the proportional valve 24 to vary the hot gas mass flow, and responsively, the cooled expanded flow from the TXV 26, to create pressure and enthalpy parameters at the operative levels needed to achieve a target temperature at the thermal load 30. In this system, the restriction of the direct flow through the load 30 reduces the pressure drop through the load 30 to a minimum. Also, the heat transfer coefficient within the load 30 is maintained at a maximum. Accordingly, the system provides superior results in achieving and maintaining target temperature.

This conclusion is exemplified by factual results achieved in the use of the PLM concept in controlling the temperature of an electrostatic chuck used in semiconductor processing. In prior systems, temperature control units have used a liquid mix of thermal exchange fluid, and provided temperature differentials of the fluid through the chuck typically averaging 10° C. (±5° C.). Using post load mixing, however, the temperature differential through the entire area of the chuck was reduced to no more than about ±3° C.

Figure 2:
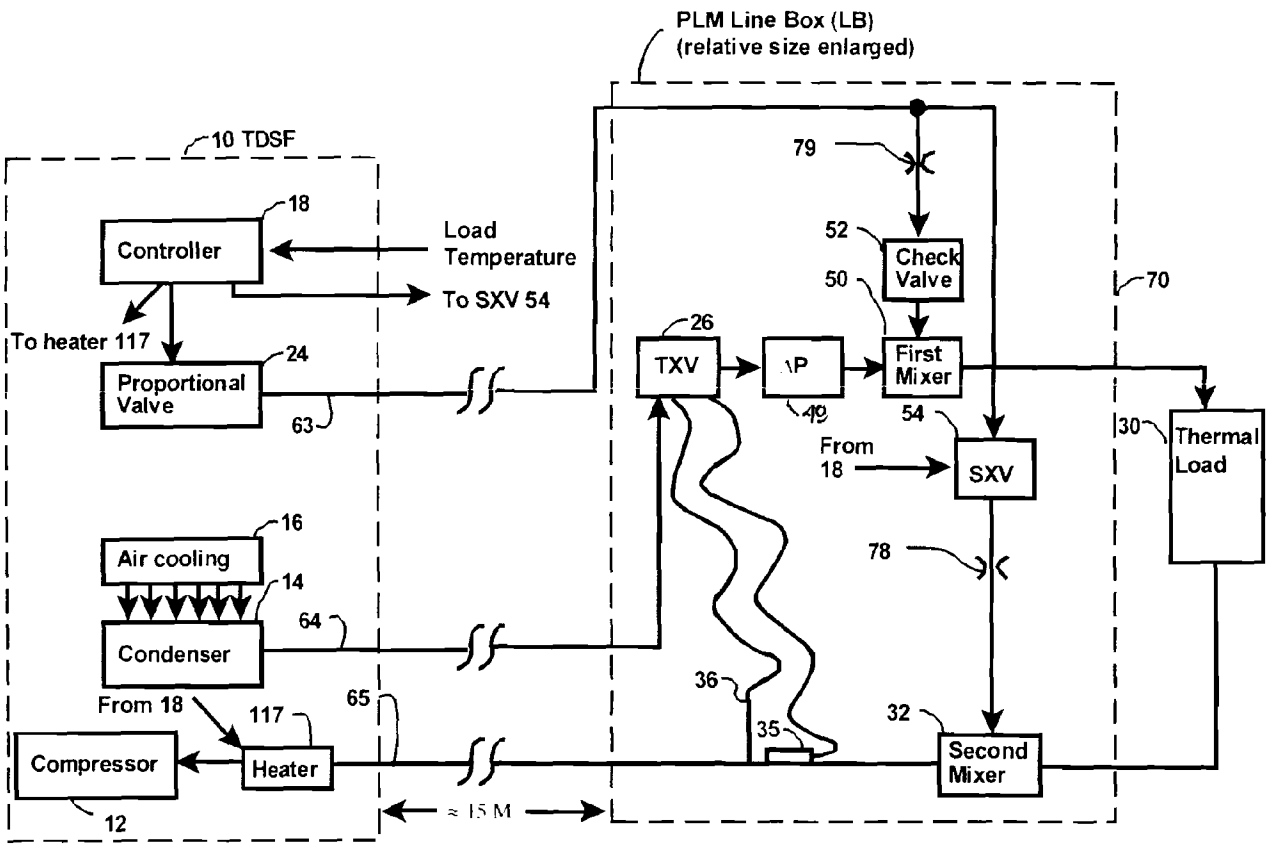
FIG. 2 is a block diagram representation of a PLM system incorporating a compact remote control box.
Figure 3:
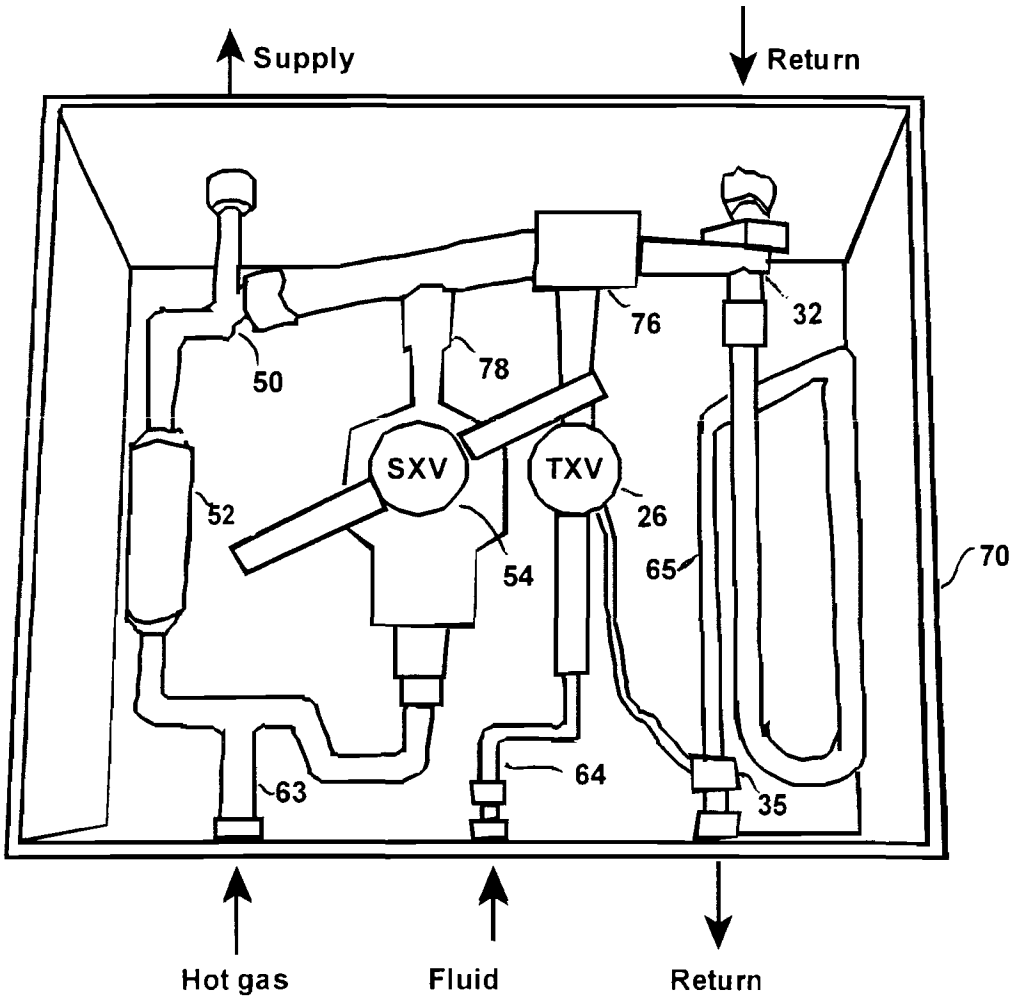
FIG. 3 is a perspective view, in plan, of an example of the elements interior to a remote control box

FIGS. 2 and 3 disclose an alternative which resolves problems of unwanted liquefaction in transporting a two-phase medium in a long line system employing the TDSF concept. For completeness, the system diagram of FIG. 2 partially repeats the principal elements of FIG. 1, placing the principal subsystems that provide phase conversion or energy consumption in a single block labeled "TDSF system" 10. From this system, a hot gas line 63 controlled by a proportional valve 24, a cooled liquid flow line 64 from the condenser 14 and a return line 65 to the compressor 12 are all coupled to a remote control box here termed a PLM Line Box (or LB) 70. The energy converting units in the TDSF system 10 are not attempted to be depicted to scale, in the interest of clarity and understanding, since the Line Box 70 is exaggerated, as the subsystems of interest. The system of FIG. 2 solves a problem which may arise because of the manipulation, in the TDSF system, of gas and liquid phases of refrigerant, in an advantageous manner for temperature control. Concurrent modulation can introduce undesired liquefaction as in the transport of the two-phase medium along a long path. The system of FIG. 2 addresses this problem effectively, and details of a specific implementation further confirming this result are shown in FIG. 3, to which reference should also be made.

In order efficiently to utilize the thermal and fluid pressure energy in the lines 63 and 64 in propagating fluids to and from the physically well separated TDSF system 10, the operative elements for mixing and control are principally located relatively remotely in what is here called a "PLM Line Box" 70, as shown in both FIGS. 2 and 3. In this practical example, the Line Box 70 is very small in volume by comparison to the energy generating subsystems. The example shown in FIG. 3 is 12"×12"×6", or 864 $in^3$, and it is typically located within about 1 meter or less from the thermal load 30 input and output points. In the LB 70, the condensate line 64 is directed to a thermo-expansion valve 26 the output of which is applied to a Δp valve 76 for pressure reduction, as is well known in TDSF systems. The thermo-expansion valve (TXV) 26 is externally equalized by pressure transmitted from a point in return line 65 via line 36. Consistent with the system diagram of FIG. 1, at a suitable point in line 65 a sensor bulb 35 is disposed in thermal communication with the return line 65 to sense the temperature of flow returning to the TDSF system 10. The output from the Δp valve 49 is combined with a portion of the high pressure hot gas flow from the line 63 that is transmitted through a check valve 52 to one input of a first mixer 50, which also receives a separate input from the Δp valve 76. The output from the first mixer 50 is, as is disclosed above in relation to FIG. 1, applied to the input of the thermal load 30.

Also consistent with the arrangement of FIG. 1, the output of the thermal load 30 is coupled to one input of a second mixer 32 having a second input ultimately receiving the flow of pressurized hot gas from the line 63. This bypass flow is, consistent with FIG. 1, directed through a solenoid valve, (designated SXV) 54 that is operated by signals from the controller 18. The input to the SXV 54 is applied via the flow control orifice 78, inserted to balance flows between the bypass path and the separate path to the thermal load 30. From the flow balancing or control orifice 78 the flow is directed to the second input of the second mixer 32 that is in circuit with the return line 65 to the compressor 12 input.

The arrangement of elements inside the PLM Remote Box 70 is shown three dimensionally in FIG. 3, with the depicted elements being numbers correspondingly to the elements in FIG. 2. Although the volumetric size, as set forth above, is very compact by comparison to the compressor and condenser units, it is fully functional for the semiconductor chuck installation. The unit can be further compacted as desired.

Incorporating the operative control elements for unification and mixing of the two flows of refrigerant in the very small volume illustrated in FIGS. 2 and 3 resolves the problem of unwanted temperature variations and accumulation of liquid in the return line, all while retaining the benefits of the PLM approach. The PLM flow balance orifices 78 and 79 control the flow proportions both before and after the thermal load 30. Furthermore, the added line in the TDSF system 10 provided by the PLM Remote Box 70 directs the bulk of hot gas around the load so that it can unite with the two-phase liquid after the load 30. Consequently the "quality" of the fluid that is fed to control the thermal load 30 is lowered, while still operating in the PLM mode. In effect, there is an increase in the liquid content in the two-phase mixture that is supplied to the load, which enhances the cooling efficacy of the two-phase liquid. The advantages of employing the PLM mode in conjunction with long line installations, are made evident in an objective way by the comparison of performance characteristics in FIG. 6, to which reference is now made. This comparison is between a conventional chiller, such as an Advanced Thermal Sciences, MP40C, and a "direct chiller" of the TDSF type that incorporates the present post-load mixing Long Line improvement. In all individual parameters that are significant to throughput and uniformity the chiller disclosure herein confirms the significant improvement in performance over a commercially state-of-the-art unit. Care was taken to ensure test conditions were comparable in all respects.

Figure 4:
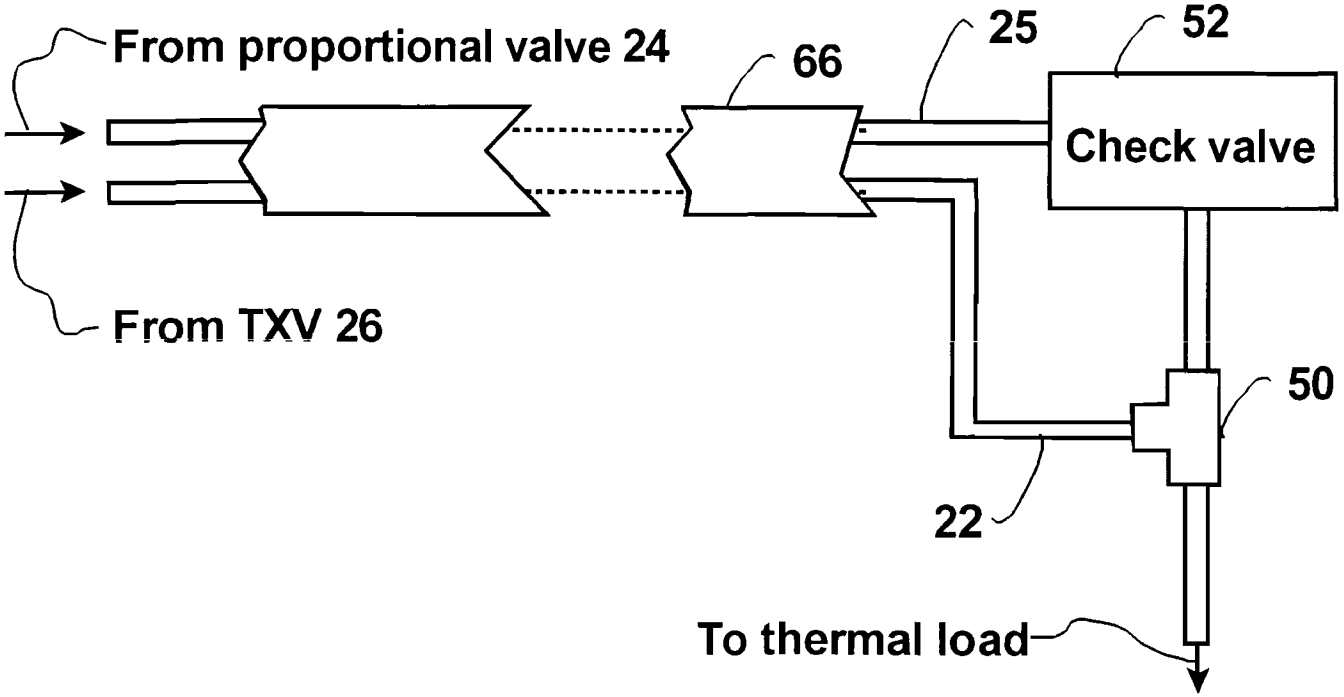
FIG. 4 is a fragmentary view of a portion of an alternate arrangement for transporting different phases of a refrigerant, processed in accordance with the TDSF concept, prior to mixing.

As a qualitatively limited alternative, when substantial line lengths might introduce problems with liquid puddling within transport lines, unstable temperature changes due to puddling can be limited or avoided using the insulation technique depicted in FIG. 4. The supply line 22 for cooled expanded flow and the output line 25 from the proportional valve 24 (both as shown in FIGS. 1 and 2) are insulated from each other within a jacket 66 until they reach the near vicinity of the load 30, as at the mixer 50.

Although there have been described above and illustrated in the drawings various forms and expedients for post load mixing, the invention is not limited thereto but incorporates all features and alternatives within the coverage of the appended claims.

The invention claimed is:

1. A system for utilizing separate flows of high pressure, high temperature fluid from a compressor to control a temperature of a thermal load having an input and an output, and comprising:

a first propagation path receiving high pressure, high temperature flow of the fluid in gaseous state from said compressor and comprising a controllable flow valve providing a variable mass flow rate, said first propagation path including circuits coupling said variable flow to an output of said thermal load;

a second propagation path receiving high temperature, high pressure fluid from said compressor, at a rate dependent on the mass flow extracted in said first propagation path;

a cooling flow circuit including a condenser disposed in said second propagation path for liquefying the received pressurized gas, and said cooling flow circuit further including;

a thermo-expansion valve for expanding and thereby cooling said second flow to an at least partially vapor state at an output;

and input circuits coupling the output of said cooling flow circuit to an input of said thermal load; and a first mixer having first and second inputs and coupled to receive a flow from said first propagation path at a first input and the output flow from said thermal load at a second input, said first mixer having an output providing a mixed output flow to the compressor, such that the temperature of said thermal load is controlled by the mixed flow.

2. A system as set forth in claim 1 above, further including a controller selecting a target temperature for said thermal load and coupled to adjust said controllable flow valve in response thereto, and a temperature sensor responsive to the temperature of said thermal load and providing a temperature reading from the thermal load to said controller.

3. A system as set forth in claim 1 above, further including a first second mixer having first and second inputs coupled to the output of said controllable flow valve and the output of said cooling flow circuit respectively, and an output coupled to the input of said thermal load.

4. A system as set forth in claim 3 above, wherein couplings from said first propagation path to said first and second mixers comprise at least one settable impedance for balancing the proportion of flows between the first and second propagation paths.

5. A system as set forth in claim 4 above, where said at least one settable impedance comprise two flow balancing orifices each coupling flow in the first propagation flow path to a different one of the first and second mixers, and wherein the first path from said compressor to the output of the thermal load includes a controller responsive shutoff valve.

6. In a thermal control system using flows of a two-phase refrigerant media divided from an initial high pressure gaseous phase into both a high temperature, high pressure gaseous phase and a post-condensed expanded phase flowing in a recirculating loop to provide thermal control of a load, said load having an input and output and said system using variable mixes of the two phases in controlled proportions, the improvement comprising:

an intermediate input circuit coupling the refrigerant media in said high temperature, high pressure phase to the output of said load in a mixer, a temperature of an output of said mixer used to control a thermo-expansive valve receiving the post-condensed expanded phase to the input of the load, to adjust the temperature level in the recirculating loop by changing the total mass flow of said refrigerant media in the high pressure gaseous phase, while concurrently tending to maximize the liquid content in the post-condensed expanded phase.

7. A thermal control system as set forth in claim 6 above, wherein said intermediate input circuit comprises a serially connected shutoff valve and a settable impedance in circuit with the flow path of the high temperature, high pressure gaseous phase, and a second settable impedance in circuit with the flow path of the post-condensed gaseous phase.

8. In a thermal control system employing a two-phase refrigerant media in both a high temperature, high pressure gaseous phase and a differential flow of post-condensed expanded cooled phase to control a temperature of a thermal load by combining controlled proportions of the two phases, the improvement comprising:

a first circuit including a first mixer for combining said expanded cooled phase with a controlled fraction of said high temperature, high pressure phase and flowing the combined flow directly through said thermal load, and a second circuit including a second mixer combining a post load mixing flow from a thermal load output with a controlled fraction of said high temperature, high pressure phase to intensify a liquid component level in the flow through the thermal load to augment temperature control by reducing temperature and pressure differences in thermal exchange with the thermal load.

9. A thermal control system as set forth in claim 8 above, wherein said first circuit and said second circuit each comprise a settable impedance for controlling the proportions of flows between the two paths, wherein the mixed flow through the thermal load can be adjusted to maximize the liquid content and thermal transfer efficiency, and lower the pressure drop through the thermal load.

10. In a temperature control system employing a two-phase thermal transfer medium and mixing controlled proportions of said medium in a pressurized hot gas phase with an expanded liquid and vapor phase, to establish a target temperature in a thermal load having an input and output, a combination for improving the resolution attainable in the target temperature, comprising:

a compressor and a condenser pressurizing and condensing loop for recycling a primary flow of two-phase refrigerant said loop dividing pressurized gaseous flow into separate flows of pressurized hot gas and condensed refrigerant in separate first and second paths, respectively, in the recycling loop;

a variable control system including a controller responsive to a target temperature and including a mass flow control device in the first path for varying the flow in said first path in a sense needed to attain the target temperature;

an expansion device in said second path for converting the differential of flow from the primary flow refrigerant in the state of condensed refrigerant to an output of at least partially gaseous phase at lower temperature;

a first mixing device having two inputs and an output, a first input being coupled to receive the output of said expansion device in the second path, and the second input being coupled to receive a portion of the variable flow from said first path, the first mixing device output being coupled to the input to said thermal load;

a second mixing device having two inputs and an output, a first input being coupled to the output of said thermal load, and a second input being coupled to receive the hot gas flow from the first path, and the second mixing device having an output coupled to said pressurizing and condensing loop for recycling the medium; and a temperature sensor for sensing a temperature of an output of the second mixing device, said temperature sensor output communicated to the expansion device to adjust the flow thereinthrough.

11. A system as set forth in claim 10 above, where the first path includes a first flow control orifice before the coupled input to the first mixing device, and a second flow control orifice and shutoff valve from the first path to the coupled input to the second mixing device, the shutoff valve being responsive to the flow control system, wherein the system further comprises a pressure dropping valve in the second path between the expansion device and the first mixing device, and a sensing device responsive to the temperature of the output flows from the second mixing device and coupled to the expansion device for internal equalization thereof.

12. A method of controlling the temperature of a thermal load using a pressurized two-phase fluid from a pressurizing energy source, in which method an initial flow of said fluid is divided into a pressurized high temperature gaseous flow and a cooled and then condensed and expanded flow of differentially higher liquid content than the initial flow, the method comprising the steps of:

varying a flow rate of said high temperature gaseous flow, thereby differentially varying a flow rate of said cooled expanded fluid;

passing at least a portion of said cooled expanded flow through said thermal load in thermal exchange relationship with said load while maintaining a liquid content therein;

mixing the output from said thermal load with said high pressure high temperature flow;

sensing a temperature of an output of the mixing;

using the temperature of the output of the mixing to adjust the flow of the cooled expanded flow; and returning a combined flow after mixing for recompression by said pressurizing energy source and completion of a continuous cycle.

13. The method as set forth in claim 12 above, including the further steps of also mixing a portion of the high temperature gaseous flow with the cooled expanded flow before passing the mixture of both flows in thermal exchange relationship with said load, whereby the load input receives cooled expanded flow that is thermally modified.

14. The method as set forth in claim 13 above, further including the steps of separately adjusting the relative flow rates of the high temperature gaseous flow rate before mixing with the cooled expanded flow and before mixing with the output from the load.

15. The method as set forth in claim 12 above, wherein said cooled expanded flow is a liquid and vapor mix at a lower temperature, than one high temperature gaseous flow and wherein the temperature of said thermal load is controlled primarily by modulation of said pressurized high penetration gaseous flow rate and the method further includes the steps of sensing the temperature of said thermal load and modulating said gaseous flow rate in response thereto.

16. The method as set forth in claim 12 above, wherein the steps of pressurizing said gaseous flow and varying said high temperature gaseous flow rate are effected at a relatively substantial distance from the thermal load, and wherein the steps of mixing said high pressure flow with said output of said thermal load and expanding said condensed fluid are effected in substantial proximity to the thermal load, whereby said two-phase fluid is transported said substantial distance without significant liquefaction before reaching the region of substantial proximity to said thermal load.

17. The method as set forth in claim 16 above, wherein the steps of mixing both before and after the thermal load include separately adjusting the high temperature flows to achieve flow balance.

18. The method as set forth in claim 12 above, further including the steps of pre-mixing a proportion of said pressurized gaseous flow with said cooled expanded flow as an input for said thermal load, and further post-mixing a proportion of said pressurized gaseous flow with the mixture flowing from said output of said thermal load, and returning the post-mixed flow for recompression by said pressurizing energy source.

19. The method as set forth in claim 12 above, wherein the method further includes the steps of adjusting said flow of the proportion of the pressurized gaseous flow after mixing with said output of said thermal load, and further including the steps of selectively terminating said high temperature gaseous flow for mixing after the load output to facilitate rapid cooling of the load.

* * * * *